United States Patent [19]

Whelan

[11] Patent Number: 4,483,460

[45] Date of Patent: Nov. 20, 1984

[54] DISPENSER FOR CONICAL STRAINERS

[75] Inventor: James P. Whelan, N. Marshfield, Mass.

[73] Assignee: Ad-Tec Products, Inc., Plymouth, Mass.

[21] Appl. No.: 450,561

[22] Filed: Dec. 16, 1982

[51] Int. Cl.[3] ..... A47F 1/08

[52] U.S. Cl. ..... 221/303; 221/309

[58] Field of Search ..... 221/307, 310, 63, 303, 221/309; 229/7 R; 206/499; 312/43

[56] References Cited

U.S. PATENT DOCUMENTS 1,429,701 9/1922 Stephens ..... 221/310

4,094,443 6/1978 Whelan ..... 221/63

*Primary Examiner*—Stanley H. Tollberg

*Attorney, Agent, or Firm*—Robert T. Gammons

[57] ABSTRACT

A dispenser for conical strainers having diametrically-projecting ears comprising elements defining a vertically-elongate, tubular structure open at its lower end and of a predetermined cross section wherein the distance between opposite corners exceeds the distance between the ears at diametrically-opposite sides of the strainers to be dispensed therefrom and supports at the open lower end of the structure located in diagonal corners comprising a single support positioned diagonally of one of the corners and spaced, parallel supports positioned diagonally of the other of the corners such as to support the rim of a strainer with its ears disposed in said corners and wherein the corner at the latter corner side is apertured to expose the ears at that corner.

5 Claims, 7 Drawing Figures

DISPENSER FOR CONICAL STRAINERS

BACKGROUND OF INVENTION

In U.S. Pat. No. 4,094,443, there is shown a dispenser for conical paint strainers having diametrically-disposed ears. The dispenser is generally of circular cross section corresponding substantially to the diameter of the strainers, has diametrically-positioned openings heightwise thereof for receiving the ears of the stacked strainers and supports at the lower end supporting the stack of strainers in such a way as to enable removing them one at a time without releasing the strainers within the structure above. The structure shown therein is eminently satisfactory for the purpose intended from the standpoint of operativeness, but is too expensive. It is the purpose of this invention to provide a dispenser embodying the dispensing capabilities of the structure shown in the aforesaid patent redesigned to make it economically feasible for manufacture.

SUMMARY OF INVENTION

A dispenser for conical strainers having diametrically-positioned ears comprising means defining a vertically-elongate structure of predetermined rectangular cross section open at its lower end wherein the distance between opposite corners exceeds the distance between the ears at diametrially-opposite sides of the strainers to be dispensed therefrom and wherein there is means at the open lower end of the structure comprising a single support positioned diagonally of two of the intersecting sides of the structure and spaced supports positioned diagonally of the other of the two intersecting sides such as to support the rim of a strainer with its ears disposed in the corners of the structure. The tubular structure is comprised of reinforced paperboard and the means at the open lower end for supporting the dispenser therein is a rigid, generally rectangular band exteriorly attached to the lower end. Two of the adjacent sides of the band are shorter than the sides of the structure and are joined by a diagonal which constitutes the support at one corner. The other two sides of the band at their intersection define an opening and at opposite sides of the opening inwardly-projecting tabs which constitute the spaced supports. Desirably, there are means attached to one side of the structure by means of which the structure can be attached to a wall.

The invention will now be described in greater detail with reference to the accompanying drawings, wherein.

Figure 1:
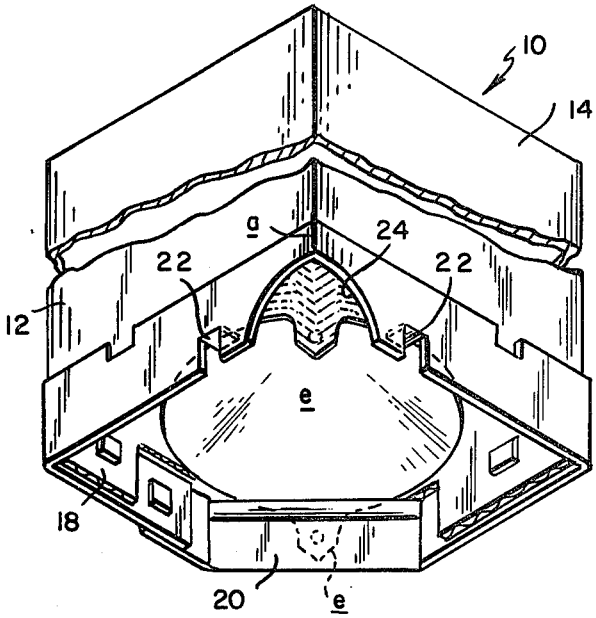
FIG. 1 is a foreshortened front perspective looking upwardly into the lower open end of the structure.
Figure 2:
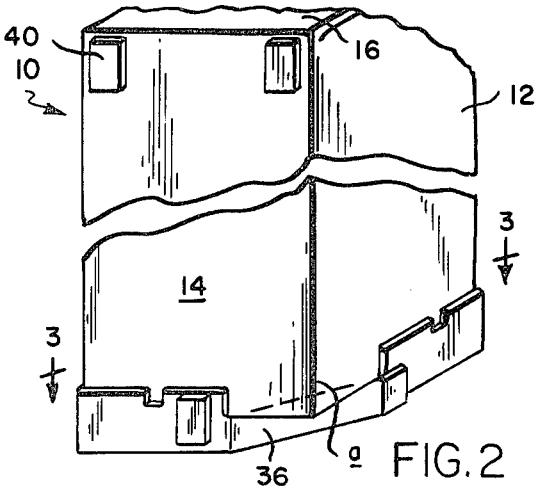
FIG. 2 is a foreshortened rear perspective.

Referring to the drawings, FIGS. 1 and 2, the dispenser 10 comprises a rectangular receptacle having spaced, parallel side walls 12—12, spaced, parallel side walls 14—14 at right angles to the side walls 12—12, and a closing top wall 16. The bottom of the receptacle is open.

Figure 7:
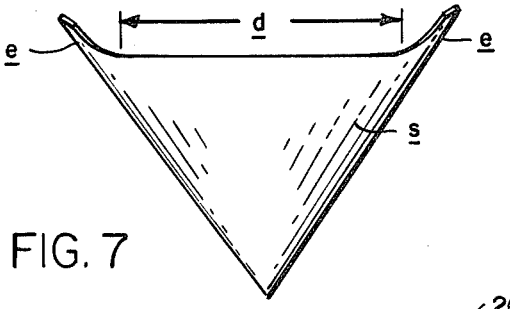
FIG. 7 is an elevation of a strainer such as is disposed from the dispenser herein illustrated.

The receptacle is desirably comprised of a reinforced paperboard 18, FIG. 1, folded to a cross-sectional dimension such that the opposite corners a—a exceed the distance between the ears e—e at diametrically-opposite sides of the strainers, FIG. 7, which are to be dispensed from the receptacle and the distance between the side walls 12—12 and 14—14 is at least equal to the diameter d of the rim of the conical strainers which are to be dispensed therefrom.

Figure 3:
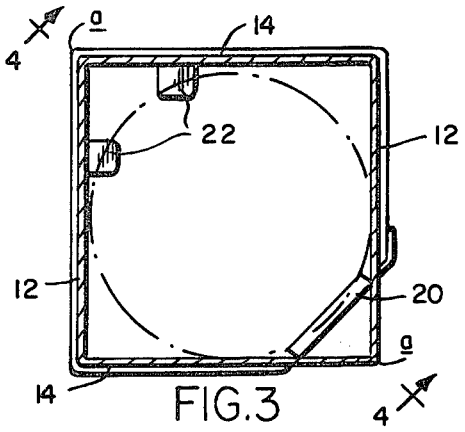
FIG. 3 is a horizontal section taken on the line 3—3 of FIG. 2.
Figure 5:
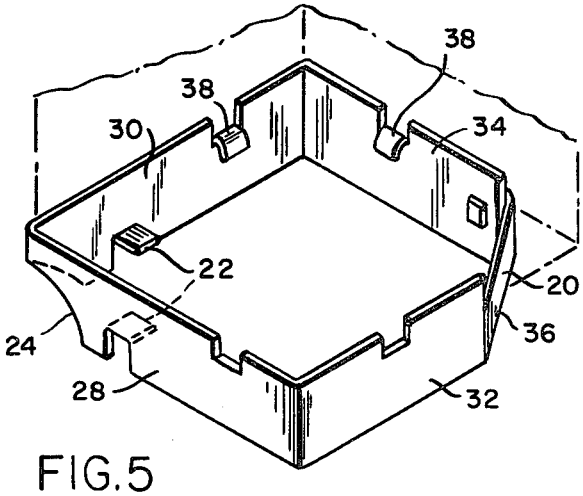
FIG. 5 is a perspective of the band at the lower end of the structure which provides the supports.
Figure 4:
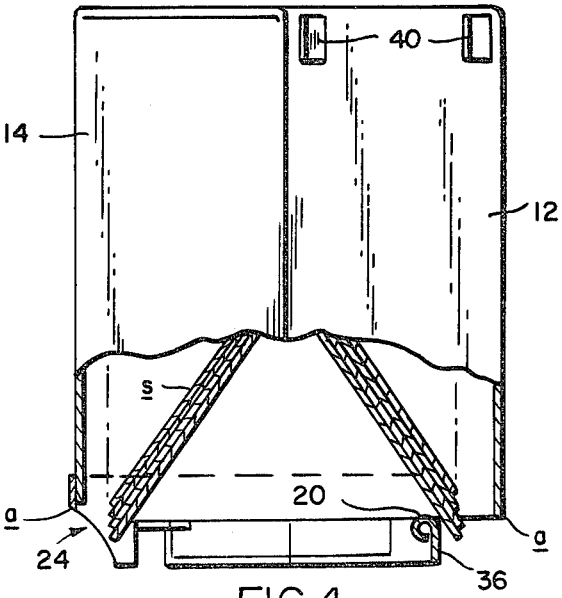
FIG. 4 is a vertical diagonal section taken on the line 4—4 of FIG. 3.
Figure 6:
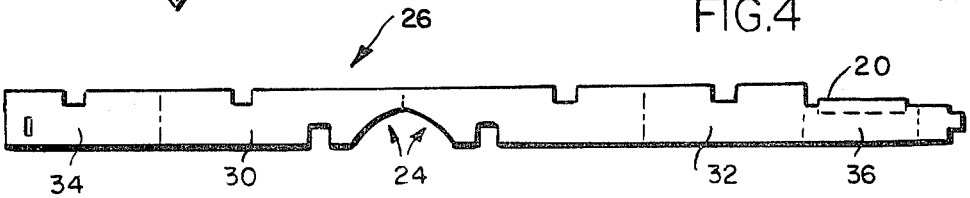
FIG. 6 is a plan view of the band before folding to rectangular configuration for application to the lower end of the structure.

In accordance with the invention, the strainers S are stacked in an inverted position within the dispenser, FIG. 4, for withdrawal from the bottom by grasping one of the two diametral ears e and pulling the lowermost dispenser downwardly through the open bottom, the structure being so designed, as will now appear, as to enable pulling a single dispenser through the open bottom without the others following. This is accomplished by providing diagonally of one of the corners a, FIG. 3, of the dispenser a supporting member 20 and at the other of the diagonal corners a a pair of spaced supports 22—22 and by providing at this latter corner between the supports 22—22 an opening 24. The structure providing the supports 20, 22—22, as shown in FIGS. 5 and 6, is a rigid strip 26 folded to provide two sides 28 and 30 of which correspond in length to two of the sides 12 and 14 and two sides 32 and 34 which are shorter than the other of the two sides 12 and 14. At the intersection of the two sides 28 and 30, the sides are arcuately recessed to provide the opening 24. These same two sides are notched at their lower sides at opposite sides of the opening 24 to provide parts which are bent inwardly to provide the supports 22—22. The aborted ends of the sides 32 and 34 are joined by a part 36, the upper edge of which is rolled and constitutes the support 20. The folded strip is applied externally to the lower end of the receptacle and is connected to the paperboard of the receptacle by means of tabs 38 struck out of the upper edge and bent inwardly through openings in the side walls and downwardly into clinching engagement therewith.

The strainers S are supported in a stack as shown in FIG. 4 with the lowermost strainer resting on the support 20 at one diametral side with the ear e at that side extending over the support 20 into the corner a at that side of the dispenser defined by the intersecting portions of the side walls 12 and 14 at that side and with the other ear e extending forwardly into the corner a at the other side formed by the intersection of the side walls 12 and 14 at the other side to a position exposed within the opening 24, FIGS. 1 and 4. The rim of the lowermost strainer at opposite sides of the ears e rest on the supports 20 and 22—22. To remove the lowermost strainer, the ear exposed in the opening 24 is grasped and pushed toward the back of the dispenser to disengage the rim from the supports 22—22, whereupon it is pulled downwardly so that it pivots downwardly on the support 20 and can be pulled free of the support 20 without disengaging the succeeding strainer.

In order to attach the receptacle to a wall for use, there are provided at one side double-faced adhesive members 40, three in number, attached to the wall.

The dispenser as described embodies the structural attributes of the dispenser shown in the aforementioned patent plus the added advantage that it can be constructed very inexpensively of two parts, to wit, a reinforced paperboard container and a support band attachable thereto which, because of the relatively small amount of material required for its makeup, provides for a dispenser which is extremely economical to manufacture both from the standpoint of material and assembly. While the strip herein illustrated is comprised of metal, for example, sheet metal which may be stamped out by means of a die-cutting machine, it can also be made of any suitably stiff plastic.

It should be understood that the present disclosure is for the purpose of illustration only and includes all modification or improvements which fall within the scope of the appended claims.

What is claimed is:

1. A dispenser for conical strainers having diametrically-projecting ears comprising means defining a vertically-elongate structure of rectangular cross section open at its lower end and of a predetermined cross section such that the distance between opposite corners exceeds the distance between the ears at the diametrically-opposite sides of the strainers to be dispensed and the distance between opposite sides is at least the diameter of the rims, means at the lower open end comprising a rigid band of rectangular configuration fixed externally to the lower end defining rigid supports internally of the structure comprising a diagonally-disposed support at one of the corners and diagonally-spaced supports at the other of the corners and wherein the supports are positioned at a radial distance from the axis of the structure which is less than the radius of the rim of the strainers such as to collectively define a three point support for the rims of the strainers positioned in the structure.

2. A dispenser according to claim 1 wherein the corner of the band wherein the diagonally-spaced, internally-positioned supports are located is apertured to provide an opening at said corner to expose the ears of the strainers at that corner.

3. A dispenser according to claim 1 wherein the band is sheet metal.

4. A dispenser according to claim 1 wherein the band is plastic.

5. A dispenser according to claim 1 wherein there are attaching elements on the band by means of which the band is attached to the lower open end of the structure by clinching said elements to the walls of the structure.

* * * * *